US012279678B2

(12) United States Patent
Galanakis

(10) Patent No.: US 12,279,678 B2
(45) Date of Patent: Apr. 22, 2025

(54) MECHANISM THAT ALLOWS THE USE OF INTERCHANGEABLE HEADS

(71) Applicant: Periklis Galanakis, Athens (GR)

(72) Inventor: Periklis Galanakis, Athens (GR)

( * ) Notice: Subject to any disclaimer, the term of this patent is extended or adjusted under 35 U.S.C. 154(b) by 0 days.

(21) Appl. No.: 18/254,379

(22) PCT Filed: Sep. 30, 2021

(86) PCT No.: PCT/GR2021/000058
§ 371 (c)(1),
(2) Date: May 25, 2023

(87) PCT Pub. No.: WO2022/112805
PCT Pub. Date: Jun. 2, 2022

(65) Prior Publication Data

US 2024/0016264 A1 Jan. 18, 2024

(30) Foreign Application Priority Data

Nov. 25, 2020 (GR) ..... 20200100700

(51) Int. Cl.
*A44C 17/02* (2006.01)

(52) U.S. Cl.
CPC ..... *A44C 17/0216* (2013.01)

(58) Field of Classification Search
CPC ..... A41D 27/08; A44B 1/32; A44C 17/0216; A44C 5/0007; A44C 25/00; A44C 9/0061; A44C 9/00; A44C 1/00; A44C 17/0208; Y10T 24/3662
See application file for complete search history.

(56) References Cited

U.S. PATENT DOCUMENTS 2,139,145 A * 12/1938 Young ..... A44B 1/28 24/104
3,933,011 A * 1/1976 DiGilio ..... A44C 17/0208 63/29.1
4,216,567 A * 8/1980 Heinz ..... A44C 5/2061 24/574.1
4,527,760 A * 7/1985 Salacuse ..... F16B 21/02 248/108
5,077,989 A * 1/1992 Dillabaugh ..... A44C 17/0216 63/29.1
5,456,095 A * 10/1995 Tawil ..... A44C 17/0216 63/15
11,330,875 B1 * 5/2022 Roeder ..... A44C 5/0007
(Continued)

*Primary Examiner* — Jack W Lavinder
(74) *Attorney, Agent, or Firm* — Michael D. Eisenberg

(57) ABSTRACT

Mechanism (1) that allows the user to replace interchangeable heads (2) of decorative and functional elements, of different sizes and designs, which shape the modular structure and image of the products in which this mechanism (1) is embedded, applies to the jewelry, fashion and smart wearables industries. The mechanism (1) comprises: an interchangeable head (2), a lug (3), forming part of the interchangeable head (2), a cover (4), a spring cover (5), a spring (6), a main body (7) of the mechanism (1) the geometry of which bears a cover recess (12) in the shape of the cover (4), two locking positions (10,11) of the lug (3) of which the second one defines the end-position (17) of the permitted movement of the lug (3) and the base (8) which is located at the bottom of the mechanism (1).

14 Claims, 12 Drawing Sheets

(56) References Cited

U.S. PATENT DOCUMENTS

| | | | | |
|---|---|---|---|---|
| 2015/0082832 | A1* | 3/2015 | Mencagli | A44B 1/32<br>2/244 |
| 2019/0045891 | A1* | 2/2019 | Yep | A44C 17/0225 |
| 2020/0121043 | A1* | 4/2020 | Kim | A44C 15/00 |
| 2023/0092219 | A1* | 3/2023 | Khinduka | A44C 9/00<br>63/15 |

* cited by examiner

MECHANISM THAT ALLOWS THE USE OF INTERCHANGEABLE HEADS

This invention relates to a mechanism. Specifically, but not exclusively, this mechanism is designed in such a way as to receive a variety of interchangeable heads, of different sizes and designs, which form the final, modular structure of the products in which this mechanism is contained. The connection of the mechanism with the interchangeable heads is achieved by the use of a lug, forming part of the interchangeable heads, located at the bottom of the interchangeable heads and which connects the parts securing the interchangeable heads inside the mechanism in one of the two available unequal locking positions.

A corresponding mechanism is known (PCT/EP2019/068912). The known mechanism is applied only to jewelry products and offers the possibility to the user to shape the final image of the jewelry it wears, by applying interchangeable heads to the mechanism. The known mechanism is significantly lagging behind in safety issues as the internal geometry, the general structure and mode of operation of various parts of the mechanism may easily lead to damage or malfunctions of parts of the mechanism which ultimately make the product to which the mechanism has been applied non-functional and therefore non-usable.

In particular, the first of the two locking positions of the interchangeable head in the known mechanism is unstable and not completely secure with a high risk of loss and destruction of the interchangeable head or destruction of the mechanism itself and consequently of the whole jewelry. This is due to the fact that the interchangeable head, in the first locking position is partially encapsulated in a cavity with a very thin roof which is the cover of the mechanism as well. The continuously applied pressure in the first locking position to the lug, forming part of the interchangeable head, by the spring and the spring cover often leads to weakening of the cover resulting in the ejection of the head. This cover is incorporated with the rest of the mechanism after its installation in the recess of the mechanism and through laser welding process. This procedure makes the strength and durability of the cover questionable over time, taking into account any damage or forces exerted on it either by pressure of the spring and the spring cover or by traction received by the interchangeable head from external factors which may destroy it; for example a tangled interchangeable head in a wool clothing or in the hair of a user who then pulls it to release it may result in the destruction primarily of the mechanism and secondarily of the product itself. This malfunction is reinforced by the fact that in the known mechanism, the gap created in the first locking position between the mechanism and the interchangeable head is sufficiently large and allows easier penetration of objects or materials which can exert pressure by pushing the interchangeable head outwards, thereby facilitating the destruction of the mechanism.

In addition, the protrusions on both sides of the spring cover and the base of the mechanism create a significant operational problem in the known mechanism. These protrusions were created to ensure that the spring is applied consistently at both ends of the protrusions in order not to lose its stability and balance within the mechanism which leads to a malfunction of the spring, as in this way two of the four coils of the spring are substantially weakened while at the same time the chances of one of these coils being deformed during their oscillation in the use and operation of the product are multiplied. Therefore, in the event that the spring is deformed and partially damaged, due to the above malfunction which is reinforced through the repeated use, and since the cover remains permanently welded to the top of the mechanism, a spring replacement is not possible leading to total damage of both the mechanism and the product bearing the mechanism.

Furthermore, the base's geometry of the known mechanism creates substantial problems during the casting process with the method of the lost wax. Most jewelry is made with this method and this mechanism cannot be made in any other way, regardless of the industry in which it is applied. The base in the model for casting of the known mechanism leads to a significant percentage, during the venting stage, to the phenomenon of accumulated bubbles within the mechanism, making this cast model non-functional. The same phenomenon was observed after thousands of casting tests of mechanisms, using either centrifugal or vacuum pressure casting. The purpose of this invention is to solve all the existing problems of the known mechanism and at the same time to increase to a significant level the ability to produce the mechanism more quickly, qualitatively, successfully and massively. This is achieved through the creation of a new mechanism, the innovations of which lead to a significantly higher degree of durability of the components of the mechanism and a strong increase in the sense of safety developed by the user, for the product. The solution of this problem is achieved according to the invention by means of the features mentioned in claim 1.

Multiple tests to solve the above-mentioned problems of the known mechanism showed that, if the cover's functionality is removed and its use as a roof in the first locking position of the lug is ceased and at the same time this functionality is transferred inside the mechanism, then the cover acquires an almost decorative character and solves the most important problem related to the safe operation and preservation of the interchangeable heads and hence, of the product in general.

In particular, the new mechanism eliminates the problematic use of the cover as a roof of the first locking position. The roof of the mechanism (1) has now been transferred to the inner walls of this cylinder which are much more compact and durable than the laser-welded cover. The cover no longer receives any substantial pressure and is mainly decorative. In addition, the gap between the head and the mechanism when the head is locked in the first position is significantly reduced, compared to the known mechanism. This is due to the fact that the first locking position is now much lower, since it has been transferred inside the main body (7) of the mechanism, compared to the position it had in the known mechanism, namely on the inner surface of the cover and thus constitutes a safe choice for the user to lock the interchangeable head. In addition, in the known mechanism, when the head is in the first locking position, it serves only in terms of safety and avoidance of loss of the interchangeable head, while in the new mechanism it can be a choice of orientation of the interchangeable head by the user since aesthetically the result is much better due to the smaller distance between the interchangeable head and the mechanism.

The need to support the spring led to the creation of the adjacent walls to the base, in the shape of a semi-circle which restrain and direct the spring to the centre of the mechanism allowing its maximum possible deployment within the mechanism and making the experience of the heads' interchange really user-friendly. At the same time, the walls significantly prevent the push of the spring and the spring cover towards the inner walls of the mechanism and, consequently, below the two locking positions, allowing its maximum expansion. In case that the spring is trapped under the walls of the mechanism, as can happen in the known mechanism, there is a possibility that the mechanism itself is not fully functional as the user tries to insert the head while the spring cannot oscillate sufficiently to exert the desired pressure due to the position in which it is located and which forces it to complete its oscillation lower, thereby not holding the interchangeable head in the locking position.

The transformation of the shapes of one side of the spring cover which is placed on one side of the spring, and of the geometry at the center of the base of the mechanism, has greatly helped the mechanism as it does not deform, weaken or destroy the spring in any way. In the new mechanism, both in the spring cover and in the base of the mechanism, a cylindrical protrusion is used that is tangent inside the spring and allows the comfortable and absolutely vertical movement of the spring, while in the known mechanism the spring is wedged in both the spring cover and the base of the mechanism, often resulting in deformations, weakening or even deviation of the direction of the spring inside the mechanism.

The base of the new mechanism is produced separately and not along with the rest of the mechanism as in the case of the known mechanism. The construction of the known mechanism is done only through 3D printing and carries high risks for loss of mechanisms either during the process of 3D printing or during the casting process while the manufacturing cost is much higher as well. In this invention the prototype of the "hollow" mechanism is 3D printed only once, a silicone mold is made out of the casted prototype and multiple, cheap and qualitative wax copies are produced through the silicone mold which are very successfully casted in contrary to the high failure rate of castings observed in the models of the known mechanism due to the phenomenon of accumulated bubbles, created at the venting stage, caused by the presence of the base of the mechanism in the model during the process of casting, centrifugal or vacuum pressure casting. The base of the new mechanism is produced by a special mold, which produces thousands of copies in a very short time and which are welded to the bottom recess of the mechanism with flamethrower, making the model completely durable and safe. In addition, the existence of two holes in parenthesis forming at the bottom of the mechanism after welding allow liquid element to enter and exit to clean and release small particles, such as sand and soil.

Figure 1:
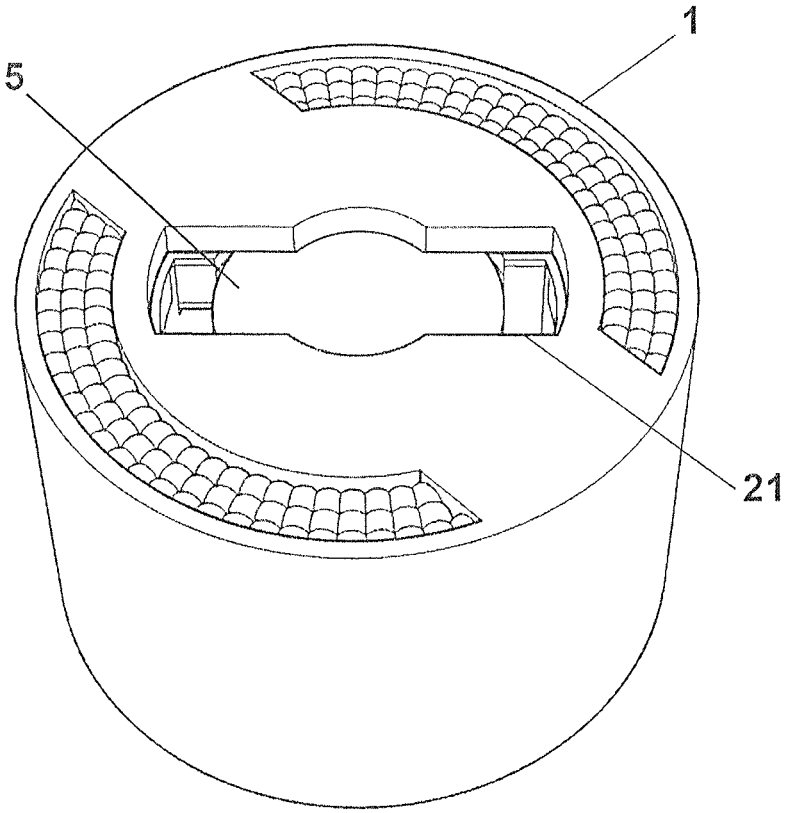
FIG. 1 shows a perspective view of the mechanism (1) which allows the use of interchangeable heads (2), the spring cover (5) and the mechanism's aperture (21) for receiving in use a lug (3) forming part of interchangeable heads (2).
Figure 2A:
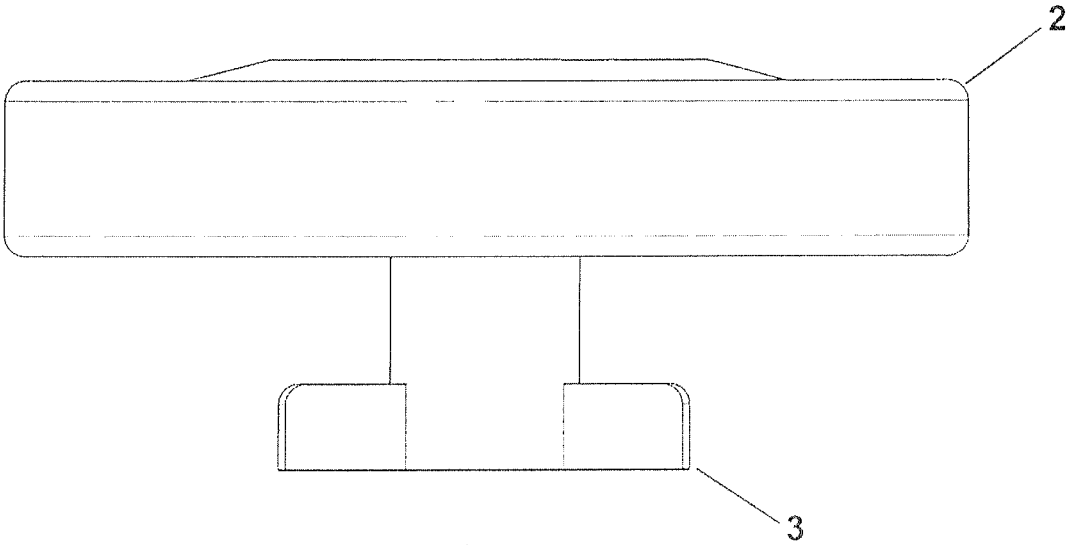
FIGS. 2A and 2B show an interchangeable head (2) and the lug (3) forming part of the interchangeable head.
Figure 2B:
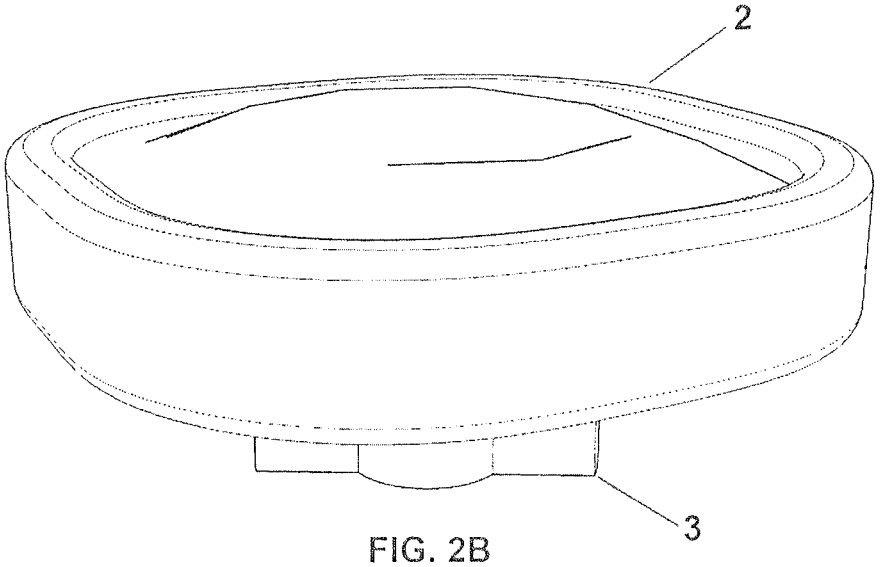
Figure 3:
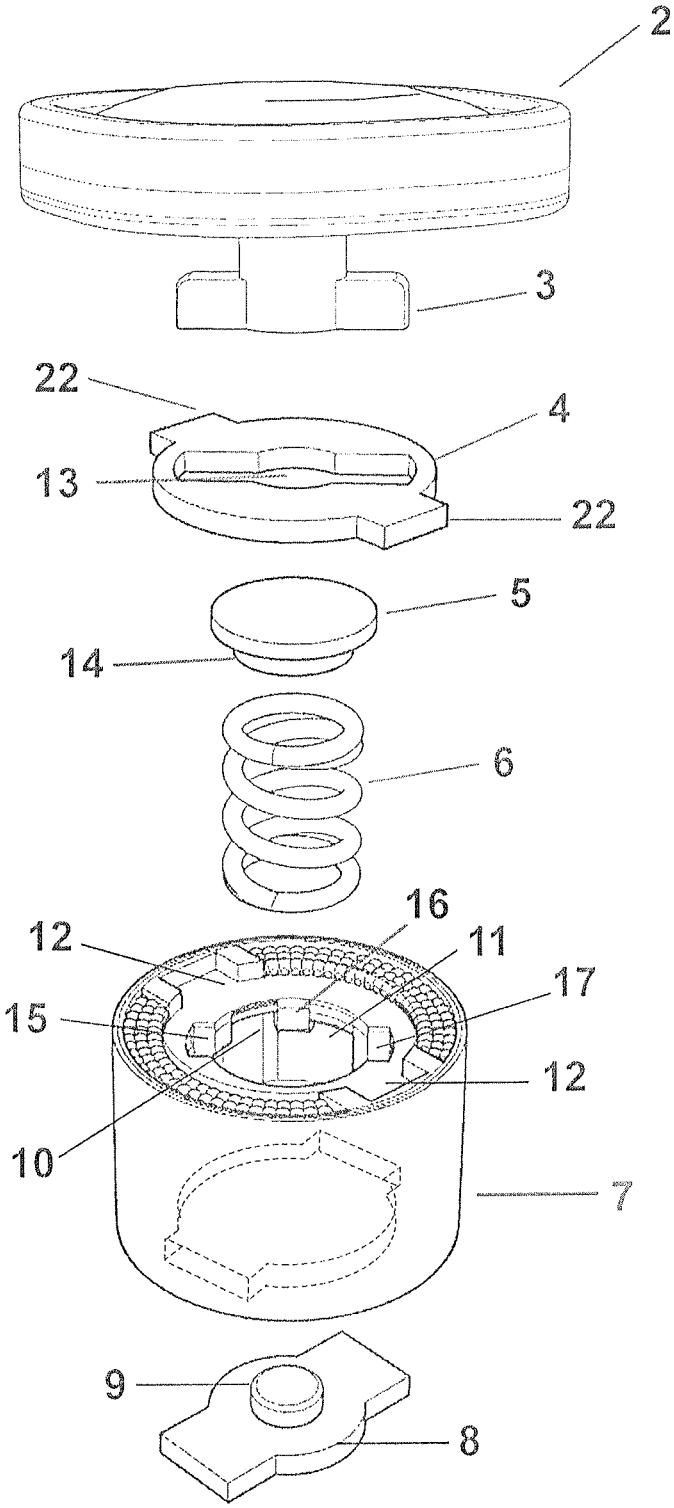

FIG. 3 shows an expanded view of the components of the mechanism (1), which are the interchangeable head (2) and the lug (3) forming part of the interchangeable head (2), the cover (4) of the mechanism bearing an aperture (13) in the shape of the lug (3) and 2 protrusions (22) of the cover (4) in its perimeter, the spring cover (5) which has a cylindrical shape and at the bottom bears a spring cover's protrusion (14) of a smaller diameter, a resilient member which is preferably a spring (6) and yet more a coil spring and alternatively, the spring may be any other resilient member such as a wave spring, torsion spring, or conical spring which is flat on the upper and lower surface, is placed in the mechanism's (1) base protrusion (9) and receives the spring cover (5), the main body (7) of the mechanism (1), the geometry of which bears a cover recess (12) for its complete incorporation, two locking positions (10,11) of the lug (3), and the base (8) of the mechanism (1) which is located at the bottom of the mechanism (1) and bears a base protrusion (9) which receives the spring (6).

Figure 4:
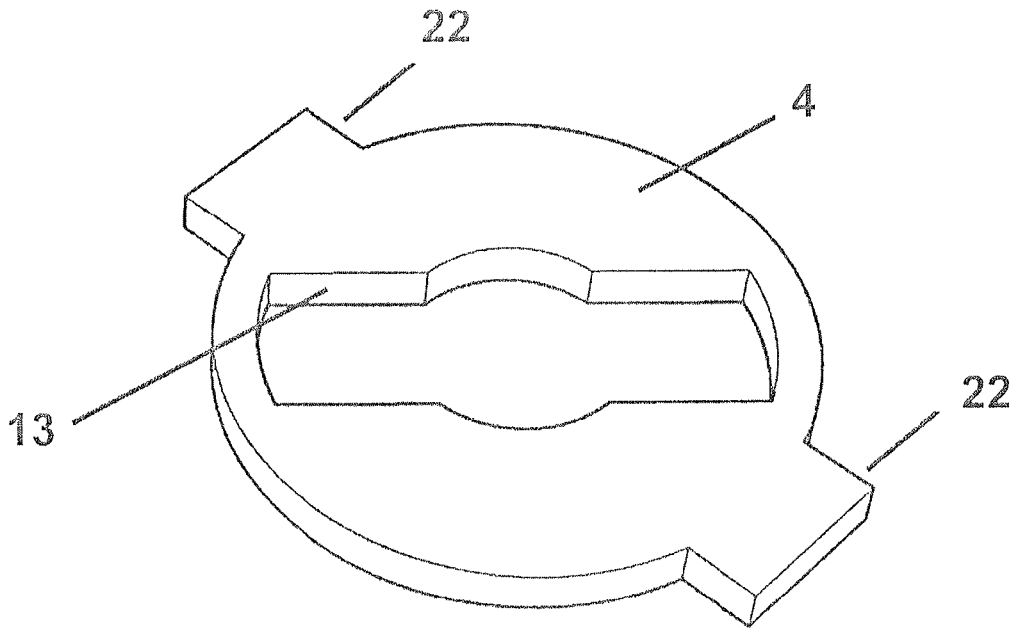

FIG. 4 shows the cover (4) of the mechanism (1) bearing an aperture (13) in the shape of the lug (3) forming part of the interchangeable head (2) and two protrusions (22) in its perimeter.

Figure 5:
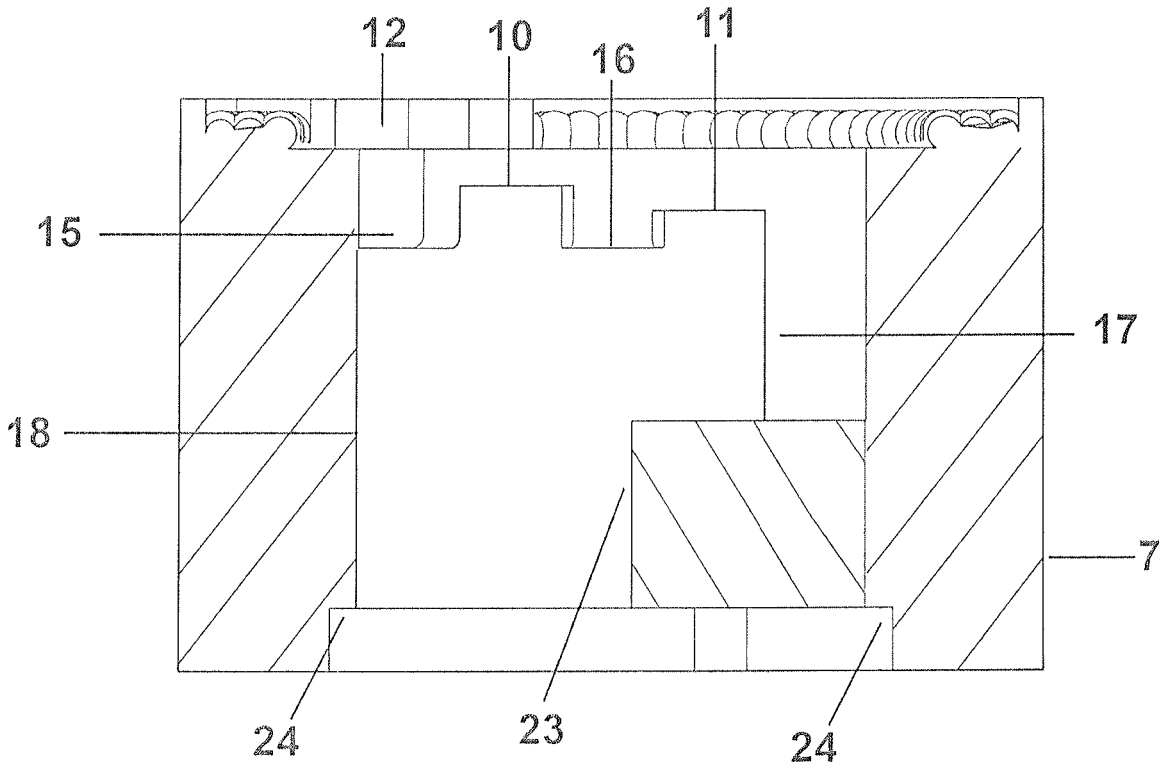

FIG. 5 shows an expanded view of the internal configuration of the main body (7) of the mechanism (1) with the two unequal locking positions (10,11) bearing side walls (15,16) while the second locking position (11) also defines the end-position (17) of the path of the permitted movement of the lug (3) within the main body (7) of the mechanism (1), the inner cavity (18) of the main body (7) of the mechanism (1), the cover recess (12) which is formed in the upper part of the main body (7) of the mechanism (1), the special configuration of the adjacent walls (23) to the base (8) and the bottom recess (24) for incorporating the base (8) of the mechanism (1).

Figure 6A:
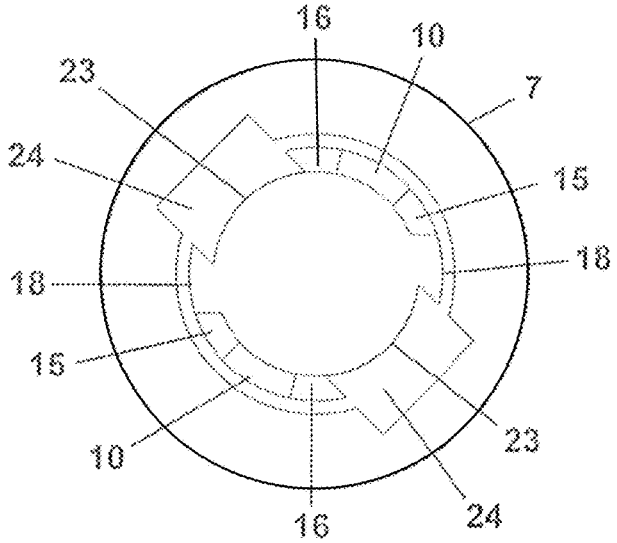
Figure 6B:
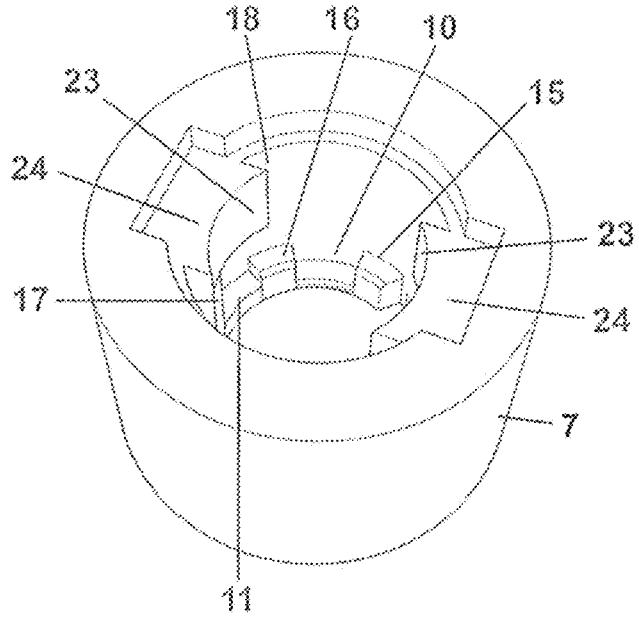

FIGS. 6A and 6B show a top and a perspective view of the bottom of the main body (7) of the mechanism (1), the two unequal locking positions (10,11) with side walls (15,16) while the second locking position (11) also defines the end-position (17) of the path of the permitted movement of the lug (3) within the main body (7) of the mechanism (1), the inner cavity (18) of the main body (7) of the mechanism (1), the special configuration of the adjacent walls (23) to the base (8) and the bottom recess (24) for incorporating the base (8) of the mechanism (1).

Figure 6C:
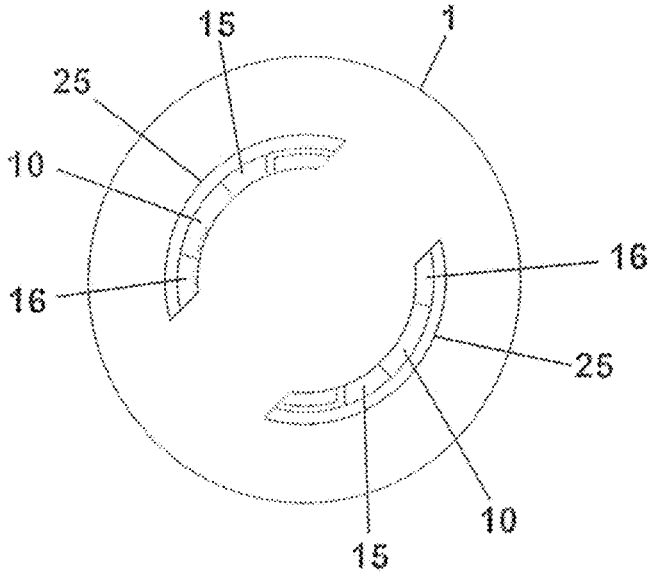

FIG. 6C shows a top view of the bottom of the mechanism (1), the first locking position (10) with its side walls (15,16) and the two cleaning access holes (25) in the shape of brackets formed at the bottom of the mechanism (1) after the incorporation of the base (8) of the mechanism (1) into the main body (7) of the mechanism (1).

Figure 7:
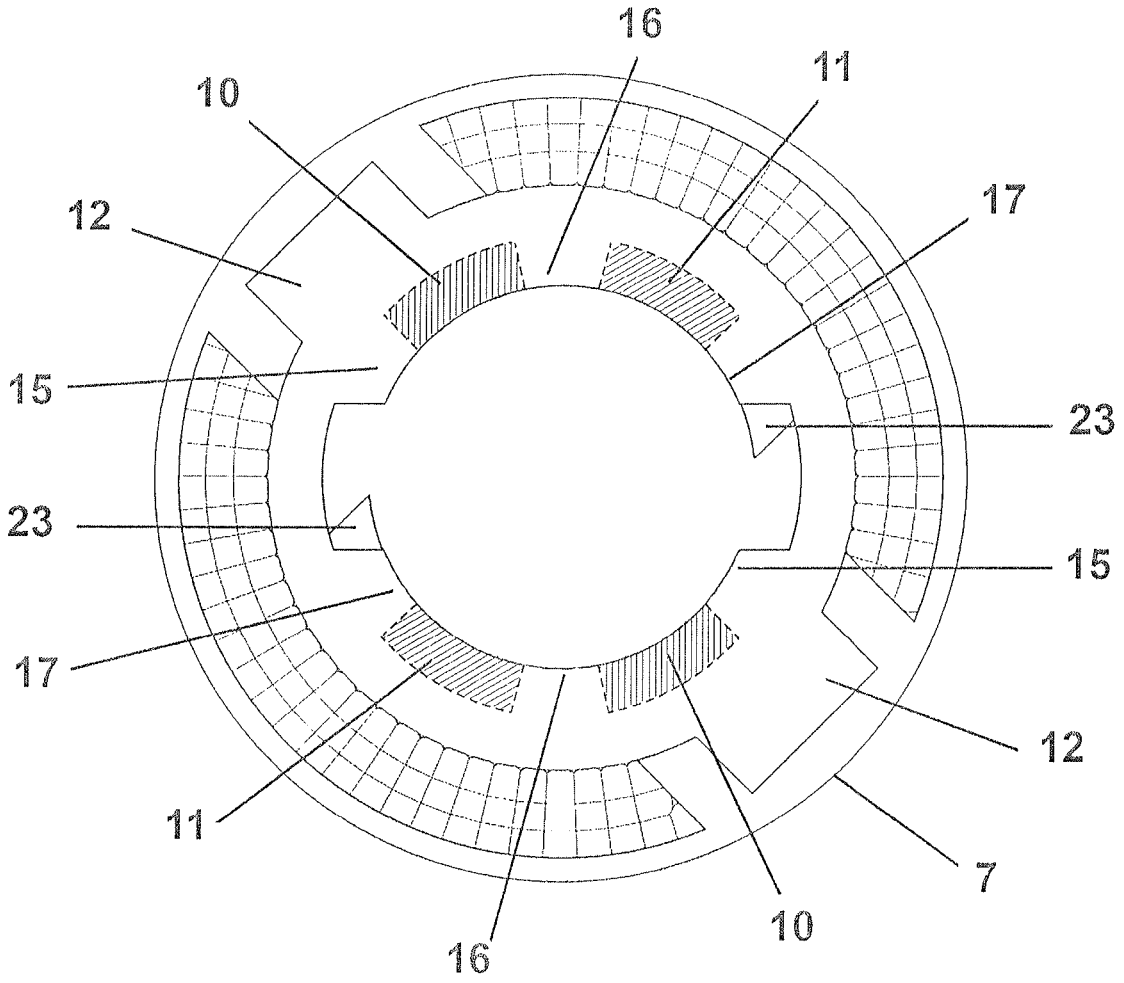

FIG. 7 shows a top view of the upper part of the main body (7) of the mechanism (1), two locking positions (10,11) of the lug (3) with side walls (15,16) while the second locking position (11) also defines the end-position (17) of the path of the permitted movement of the lug (3) within the main body (7) of the mechanism (1), the special configuration of the adjacent walls (23) to the base (8) of the mechanism (1) and the cover recess (12) of the main body (7) of the mechanism (1) which receives the cover (4) of the mechanism (1).

Figure 8A:
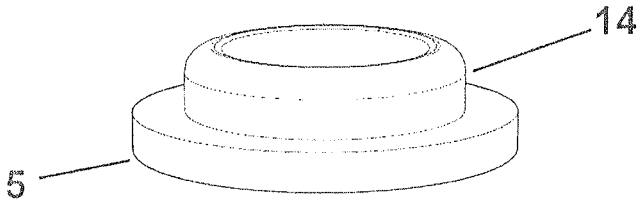
Figure 8B:
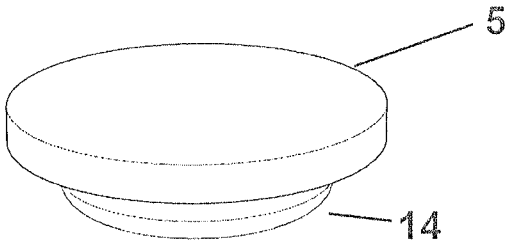
Figure 8C:
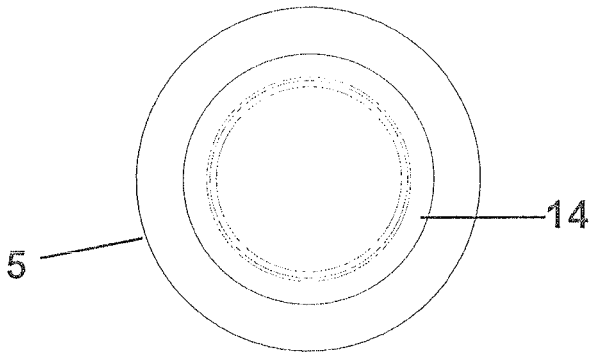

FIGS. 8A, 8B and 8C show a top and two perspective views of the geometry of the spring cover (5) and the spring cover's protrusion (14) which the spring cover (5) bears at its bottom and allows it to be placed on the top of the spring (6).

Figure 9A:
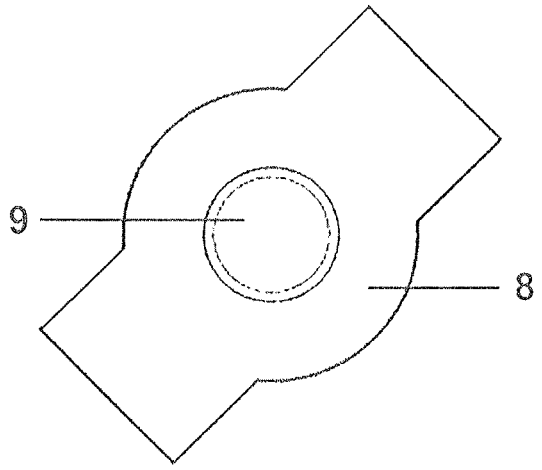
Figure 9B:
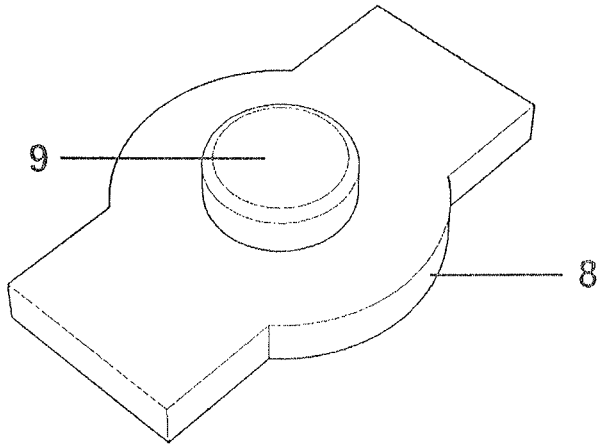
Figure 10A:
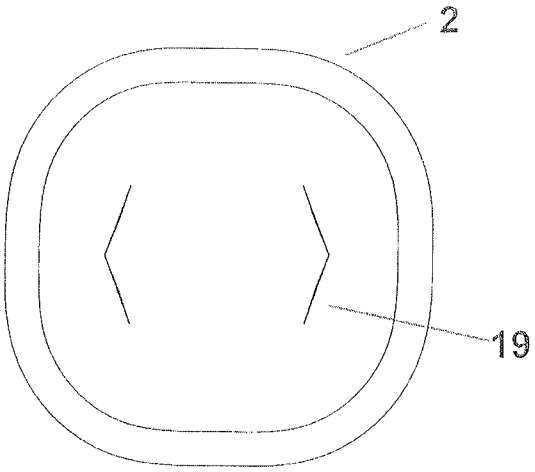
Figure 10B:
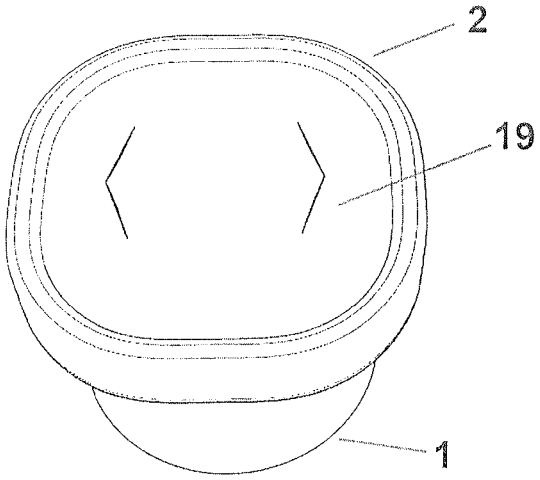
Figure 10C:
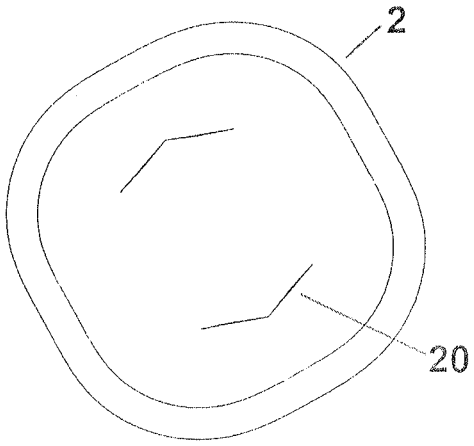
Figure 10D:
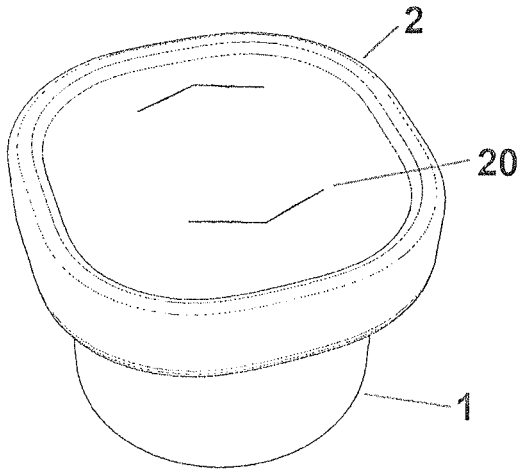

FIGS. 9A and 9B show a top and a perspective view of the base (8) of the mechanism (1) which is located at the bottom of the mechanism (1) and bears a base protrusion (9) which receives the spring (6).

FIGS. 10A, 10B, 10C and 10D indicate the orientation (19,20) of the interchangeable heads (2) when they are fastened to either the first locking position (10) or the second locking position (11) of the mechanism (1). The orientation (19) of FIGS. 10A and 10B corresponds to the second locking position (11) while the orientation (20) of FIGS. 10C and 10D corresponds to the first locking position (10).

Figure 11A:
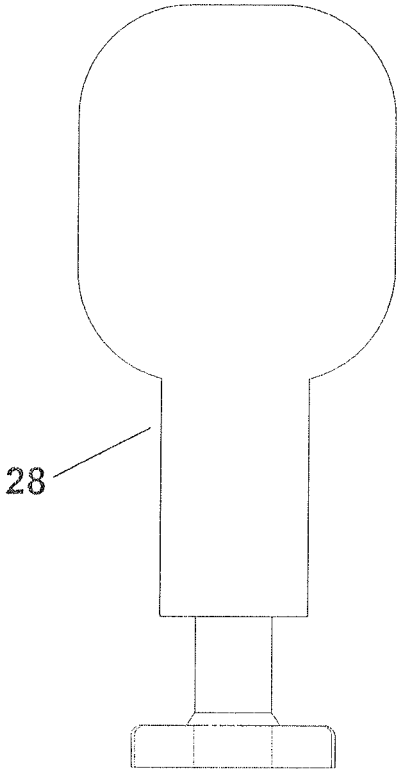

FIG. 11A shows a specialized tool (28) mounted in the position of the interchangeable head (2) which is designed and constructed in such a way that the cover (4) can be laser welded to the main body (7) of the mechanism (1), very easily and fast. The extended length of its lug (3) combined with its small width allows the craftsman to have good visibility and not to obstruct his work the shape of the interchangeable heads (2) which are always located very close to the main body (7) of the mechanism (1).

Figure 11B:
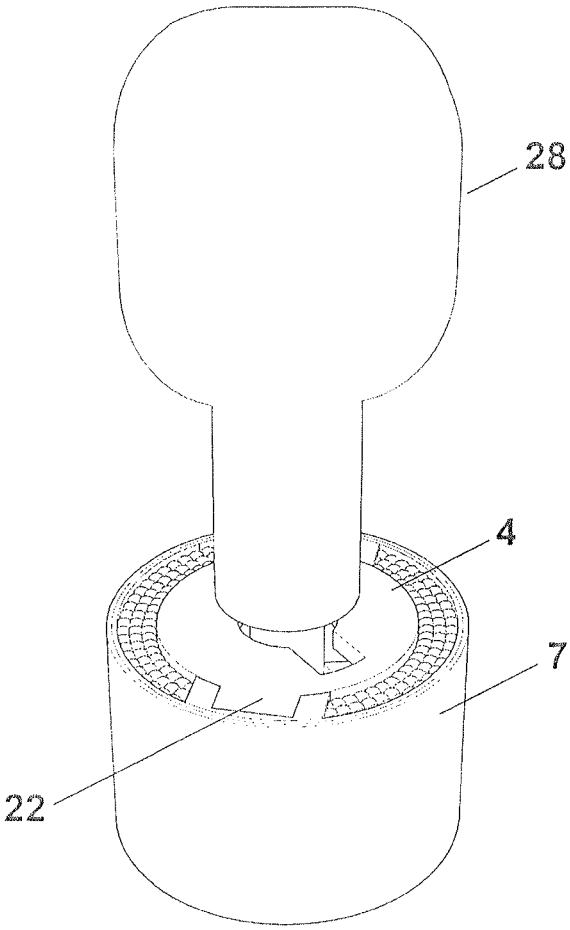
Figure 12A:
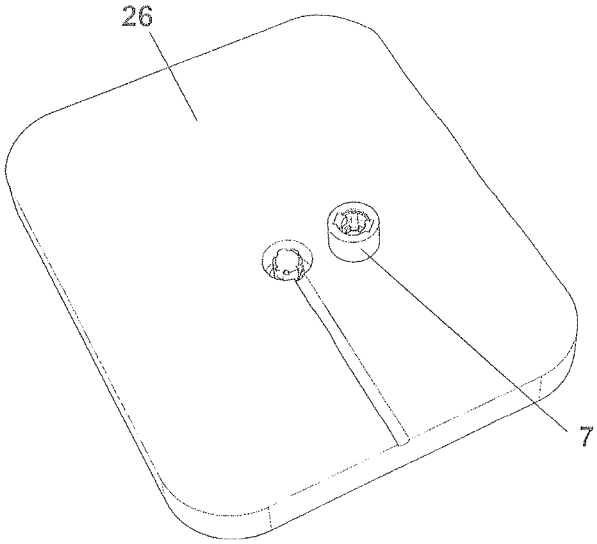
Figure 12B:
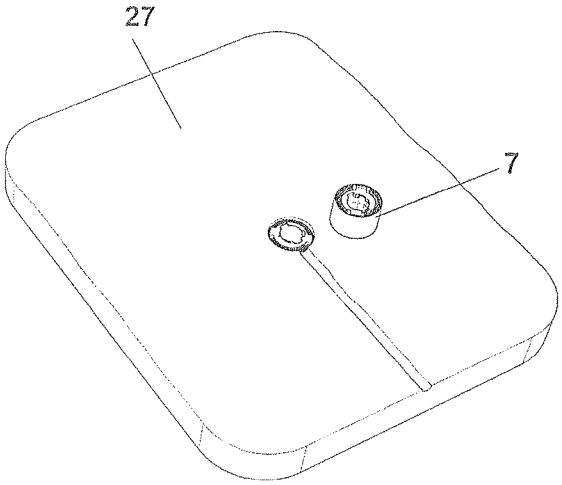
Figure 12C:
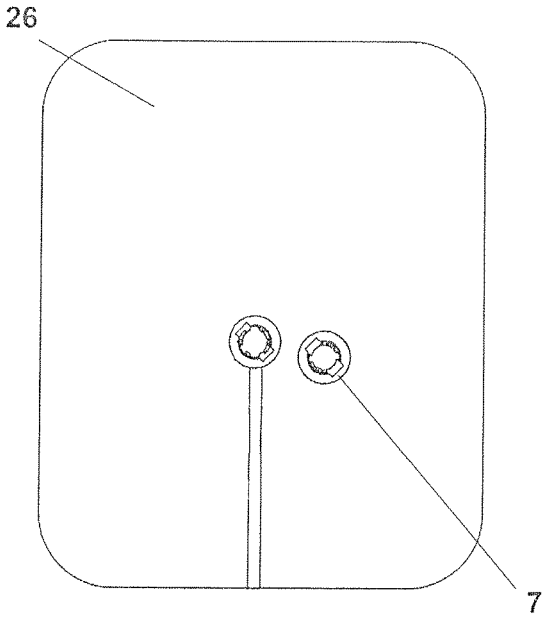
Figure 12D:
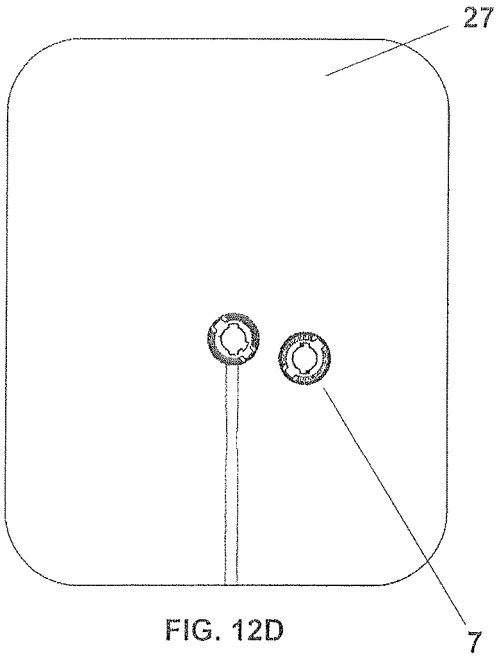

FIG. 11B shows the specialized tool (28) mounted in one of the two locking positions (10,11). In this way, the cover (4) is released from the pressure that would otherwise be exerted on it by both the spring (6) and the spring cover (5) and that would make the work of the craftsman much more difficult during the laser welding process.

FIGS. 12A, 128, 12C and 12D show in perspective and top view of the silicone mold (26,27) used to imprint the shape of the metallic prototype of the main body (7) of the mechanism (1) on the silicone and then used for the purpose of large-scale production of wax copies of the main body (7) of the mechanism (1).

The mechanism that allows the use of interchangeable heads is specifically, but not exclusively, used in the field of jewelry, offering users the opportunity to become the creators of their own, personalized jewelry. The users, having bought some interchangeable heads as decorative elements but also jewelry with new mechanisms embedded, which are boxed in rings, pendants, earrings, bracelets, cufflinks, pins, etc., have the ability to change their image whenever they wish. In addition, no tool is required for the interchange of the interchangeable heads while the totally safe and user-friendly operation of the mechanism leads to a strong and interactive relationship between the user and the product bearing the mechanism. Furthermore, the interchangeable heads can bear a decorative element on top of them and inside the interchangeable head (2) could be embedded a fully functional microcircuit of various technologies, e.g. NFC, RFID (Near Field Communication, Radio Frequency Identification) which is not visible to the user and alternates among mechanisms (1) that are parts of smart devices and smart accessories. Additionally, the use of the mechanism (1) in multiple products allows the interchange of interchangeable heads (2) and enables a user to give the interchangeable head (2) to another user with the microcircuit it may need. E.g., an interchangeable head with an embedded nfc microcircuit, which operates as a door key and as a decorative element of a piece of jewelry as well, is given by a user to another user who applies it on its own mechanism (1) which is embedded into its own product bearing a mechanism (1) and uses it to open a specific door. The mechanism (1) carried by each user through the product in which it is embedded, is in essence the means of transport of the interchangeable head (2) which is transferred from user to user, at will.

What is claimed is:

1. A holder for removably holding an interchangeable ornamental insert (2) having a lug (3), the holder comprising:

a main body (7) having:

an inner cavity (18) surrounded by a wall on sides thereof;

a pair of adjacent walls (23) extending radially inwards from a bottom of the wall and having a space therebetween, wherein the pair of adjacent walls are recessed with respect to the bottom of the wall, thereby forming a bottom recess (24);

a roof of having a top perforation which communicates with the inner cavity;

a pair of first side walls (15) extending downward from the roof, such that gaps are present between the first side walls and a bottom end of the main body;

a pair of end positions (17) extending inward from the wall;

wherein two locking positions are formed, each of the locking positions being located between one of the first side walls and one of the end positions, the locking positions being located opposite each other, for receiving opposite ends of the lug;

wherein the top perforation comprises two radial extensions extending outwards from a center of the top perforation, for insertion of the lug into the inner cavity.

2. The holder of claim 1, further comprising:

a base (8) sized to fit into the bottom recess (24) to be joined to the main body and to cover at least part of the bottom end of the main body;

a spring (6) joined to an upper surface of the base and configured to be located inside the inner cavity when the base is joined to the main body.

3. An ornamental piece of jewelry, comprising:

at least one ornamental insert (2) having a lug (3);

the holder of claim 2 for removably receiving the at least one ornamental insert (2).

4. The holder of claim 2, wherein the base comprises a base protrusion (9) configured to receive and hold the spring (6).

5. The holder of claim 2, comprising a spring cover (5) joined to a top of the spring (6).

6. The holder of claim 5, wherein the spring cover (5) comprises a protrusion (14) extending from a bottom of the spring cover (5) for joining the spring cover (5) to the top of the spring (6).

7. The holder of claim 2, wherein the roof has a cover recess (12), while the holder comprises a cover (4) sized to fit into the cover recess (12) and be held by the roof, to be joined to the roof, the cover (4) having an aperture (13) aligned with the top perforation of the roof when the cover is joined to the roof, for insertion of the lug therethrough.

8. A method for constructing the holder of claim 7, the method comprising:

a) welding the base (8) to the bottom recess (24);

b) joining the spring (6) to the base (8);

c) placing the cover (4) on the cover recess (12);

d) inserting a portion of a specialized tool (28) having a second lug into the holder and rotating the specialized tool, such that the second lug is pressed by the spring (6) against a bottom surface of the roof in a holding position, to prevent rotational motion of the second lug;

e) welding the cover (4) to the cover recess (12);

f) removing the specialized tool (28) from the holder.

9. The method of claim 8, wherein:

the base (8) comprises a base protrusion (9);

joining the spring (6) to the base comprises joining the spring (6) to the base protrusion (9).

10. The method of claim 8, wherein:

the holder comprises a spring cover (5);

the method comprises, between step (b) and (c), joining the spring cover to a top of the spring.

11. The holder of claim 1, further comprising:

a pair of second side walls (16) extending downward from the roof such that gaps are present between the pair of second side walls and the bottom end of the main body, each one of the pair of second side walls being located between one of the pair of first side walls (15) and one of the pair of end positions (17);

wherein the locking positions comprise two first locking positions (10) and two second locking positions (11);

wherein two first locking positions (10) are formed, such that each of the first locking positions is located between one of the pair of first side walls and an adjacent one of the pair of second side walls, the first locking positions being located opposite each other, for receiving opposite ends of a lug;

wherein the two second locking positions (11) are formed, such that each of the second locking positions is located between one of the pair of second side walls and an adjacent one of the pair of end positions, the second locking positions being located opposite each other, for receiving the opposite ends of the lug.

12. The holder of claim 1, wherein the inner cavity is cylindrical.

13. The holder of claim 1 wherein the main body (7) is made from a single material.

14. The holder of claim 13, wherein the main body (7) is made via 3-dimensional printing, molding, or casting.

* * * * *